United States Patent [19]

Pfeffer

[11] Patent Number: 4,951,589

[45] Date of Patent: Aug. 28, 1990

[54] MAINSAIL CONSTRUCTION FACILITATING AIRFLOW THEREOVER

[76] Inventor: Thomas T. Pfeffer, Timberlane Dr., Pennington, N.J. 08534

[21] Appl. No.: 390,860

[22] Filed: Aug. 8, 1989

Related U.S. Application Data

[63] Continuation-in-part of Ser. No. 187,599, Apr. 28, 1988, abandoned.

[51] Int. Cl.[5] ..... B63H 9/04; B63H 9/06

[52] U.S. Cl. ..... 114/103; 114/102; 114/104; 114/105; 114/39.1

[58] Field of Search ..... 114/103, 102, 39.1, 114/39.2, 104, 105

[56] References Cited

U.S. PATENT DOCUMENTS

| | | | |
|---|---|---|---|
| 3,820,493 | 6/1974 | Amick | 114/39.1 X |
| 4,280,431 | 7/1981 | Sofen | 114/105 |
| 4,347,799 | 9/1982 | Moriarty | 114/102 |
| 4,354,444 | 10/1982 | Puretic | 114/102 X |
| 4,432,298 | 2/1984 | Cudmore | 114/103 X |
| 4,745,871 | 5/1988 | Wieder | 114/105 X |
| 4,811,678 | 3/1989 | Sogell | 114/102 X |

FOREIGN PATENT DOCUMENTS

| | | | |
|---|---|---|---|
| 3342911 | 6/1985 | Fed. Rep. of Germany | 114/103 |
| 2543509 | 10/1984 | France | 114/39.2 |
| 2552393 | 3/1985 | France | 114/103 |
| 84295 | 5/1982 | Japan | 114/103 |
| 167894 | 10/1982 | Japan | 114/103 |
| 1077 | 12/1979 | PCT Int'l Appl. | 114/103 |

*Primary Examiner*—Joseph F. Peters, Jr.
*Assistant Examiner*—James M. Kannofsky
*Attorney, Agent, or Firm*—Sperry, Zoda & Kane

[57] ABSTRACT

An improved mainsail construction having a barrier extending laterally outward from the mainsail and the mainsail boom to prevent flow of air from the high pressure side to the low pressure side of the sail and thus improve efficiency thereof. The barrier is detachably securable with respect to the mainsail and the mainsail boom such as being capable of being removed and oriented to act as a sail cover or weather protection device.

21 Claims, 3 Drawing Sheets

MAINSAIL CONSTRUCTION FACILITATING AIRFLOW THEREOVER

This application is a continuation-in-part of U.S. Ser. No. 07/187,599, filed Apr. 28, 1988, now abandoned.

BACKGROUND OF THE INVENTION

1. Field of the Invention

The present invention deals with the field of devices which improve airflow over sailcraft mainsails, boom jibs, and/or mizzen sails in such a manner as to improve the driving force and reduce the resistance force thereof.

A sail is much like an airplane wing in that it generates driving force responsive to a difference in air velocities as the air flows over the curved surfaces thereof. In this manner, air pressure differential is generated by virtue of velocity acceleration being higher on the leeward side than on the windward side. This results in a problem being created at the ends of the sails where the air tends to flow from the high pressure side to the low pressure side. Such cross flow reduces the difference in pressures and thus reduces driving force.

A circular airflow pattern or vortex can be created in this manner which tends to rob energy from the air velocity and hence increase the sail resistance force. The present invention provides a novel means for minimizing the airflow circulation from the high pressure side to the low pressure side of a sail.

2. Description of the Prior Art

Devices for overcoming these types of problems are many and varied in the prior art such as those shown in U.S. Pat. No. 3,820,493 issued June 28, 1974 to James L. Amick for Sailboat Improvements; U.S. Pat. No. 4,280,431 issued July 28, 1981 to Morris B. Sofen for a Device For Supporting And Storing The Mainsail Of A Sailboat On The Boom Thereof; U.S. Pat. No. 4,347,799 issued September 1982 to Vincent C. Moriarty for a Sail Catcher; U.S. Pat. No. 4,354,444 issued Oct. 19, 1982 to Mario J. Puretic for a Sail Handling Apparatus; U.S. Pat. No. 4,432,298 issued Feb. 21, 1984 to Patrick J. Cudmore for a Hydrofoil Sailing Craft; U.S. Pat. No. 4,745,871 issued May 24, 1988 to Edwin F. Wieder for a Method And Apparatus For Covering And Containing A Sail; French Pat. No. 2543509 issued October, 1984; French Pat. No. 2552393 issued September, 1983; Japenese Pat. No. 57-167894 issued October, 1982; Japenese Pat. No. 57-84295 issued May, 1982; German Patent No. 3342911 issued June, 1985 and PCT Pat. No. 79/01077 issued December, 1979.

SUMMARY OF THE INVENTION

The present invention comprises a mainsail and a mainsail boom with the mainsail including a high pressure side and a low pressure side defined thereon for achieving sail pressure differential. A barrier is detachably mounted with respect to the mainsail boom and extends outwardly therefrom to minimize airflow circulation from the high pressure side thereof to the low pressure side thereof. The barrier is adapted to maximize the effective area of the mainsail utilized for producing the driving force. The barrier is movable between a closed position and an opened position such that when in the closed position the barrier is capable of extending over the mainsail to facilitate covering and weather protection thereof. The barrier means may also be attached directly with respect to the mainsail boom in such a manner that when it is in the opened position it extends outwardly horizontally therefrom.

Preferably the barrier includes a first barrier member detachably secured with respect to one side of the mainsail boom and extending outwardly approximately horizontally therefrom. This first barrier preferably includes a plurality of first rib members extending therealong and preferably sewn into the cloth barrier to facilitate holding of the barrier in the expanded position. Similarly, a second barrier member may be detachably secured with respect to the other side of the mainsail boom in such a manner as to extend approximately horizontally outwardly therefrom. One or more second rib members may be also sewn within the cloth second barrier in such a manner as to hold the second barrier in the expanded position.

A bracket device may be included secured directly to the mainsail boom which may include a first bracket member defining a first slot therein which is adapted to receive one of the first rib members to be detachably retained therein thereby facilitating detachable securement of the first barrier member with respect to the mainsail boom. Similarly, a second bracket member may define a second slot therein which is adapted to receive the second rib member detachably retained therein to facilitate detachable securement of the second barrier with respect to the mainsail boom.

Preferably the removal of the first and second barriers from positioning within the first and second slots attached to the first and second brackets will be made in such a manner that the barriers can be reoriented and secured with respect to one another to cover the mainsail when in the down position.

It is an object of the present invention to provide an improved mainsail construction facilitating airflow transfer thereover wherein driving force against a mainsail is maximized.

It is an object of the present invention to provide an improved mainsail construction facilitating airflow transfer thereover wherein resistance force of a mainsail is reduced to a maximum extent.

It is an object of the present invention to provide an improved mainsail construction facilitating airflow transfer thereover wherein initial capital outlay is minimized.

It is an object of the present invention to provide an improved mainsail construction facilitating airflow transfer thereover wherein maintenance costs are minimized.

It is an object of the present invention to provide an improved mainsail construction facilitating airflow transfer thereover wherein a barrier utilized to minimize airflow between the high and low pressure sides is detachable and capable of reorientation to provide a sail cover.

It is an object of the present invention to provide an improved mainsail construction facilitating airflow transfer thereover wherein a circular airflow pattern otherwise known as a vortex is prevented adjacent the rear edges of sails which result in airflow from the high to the low pressure side thereof.

It is an object of the present invention to provide an improved mainsail construction facilitating airflow transfer thereover wherein approximately horizontally extending barriers are included with rib members extending therethrough for holding the barrier in the fully expanded position.

It is an object of the present invention to provide an improved mainsail construction facilitating airflow transfer thereover wherein the efficiency of the driving force of a sail is maximized.

It is an object of the present invention to provide an improved mainsail construction facilitating airflow transfer thereover wherein the amount of sail required to generate a given driving force is minimized.

It is an object of the present invention to provide an improved mainsail construction facilitating airflow transfer thereover wherein the heeling moment acting upon a sailcraft is minimized.

It is an object of the present invention to provide an improved mainsail construction facilitating airflow transfer thereover wherein it is possible to increase the sail area for a given heeling moment to result in an increase in the driving force and speed potential of a given sailcraft.

It is an object of the present invention to provide an improved mainsail construction facilitating airflow transfer thereover wherein an airflow barrier is positioned which is simple, practical, and relatively inexpensive and can be added in whole or in part on any sail as desired.

It is an object of the present invention to provide an improved mainsail construction facilitating airflow transfer thereover wherein reduced mast height is made possible.

It is an object of the present invention to provide an improved mainsail construction facilitating airflow transfer thereover wherein reduced sail area is made possible.

It is an object of the present invention to provide an improved mainsail construction facilitating airflow transfer thereover wherein reduced ballast requirements are achieved.

It is an object of the present invention to provide an improved mainsail construction facilitating airflow transfer thereover wherein attachment as an after market device to already existing sailcraft is facilitated.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

BRIEF DESCRIPTION OF THE PREFERRED EMBODIMENTS

Figure 8:
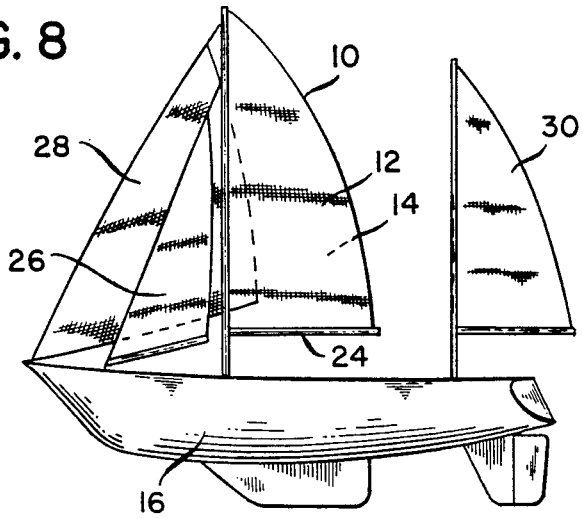
FIG. 8 is a schematic illustration of a sailcraft of the prior art.

The improved mainsail construction facilitating airflow of the present invention includes a mainsail 10 having a high pressure side 12 and a low pressure side 14 defined thereon. In the prior art configuration shown in FIG. 8, the hull 16 of the sailcraft is shown with the mainsail 10 positioned centrally thereon. A mizzen sail 30 is positioned to the rear thereof and a mainsail boom means 24 is positioned extending below the mainsail 10. Boom jib 26 and jib 28 are shown in this depiction of the prior art also.

Figure 1:
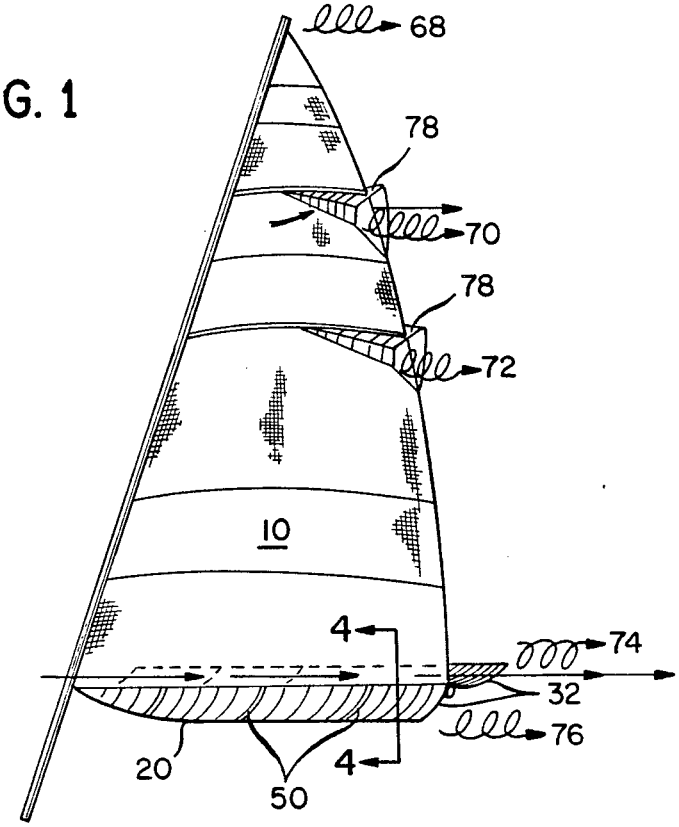
FIG. 1 is a side elevational view of an embodiment of the improved mainsail construction of the present invention.
Figure 7:
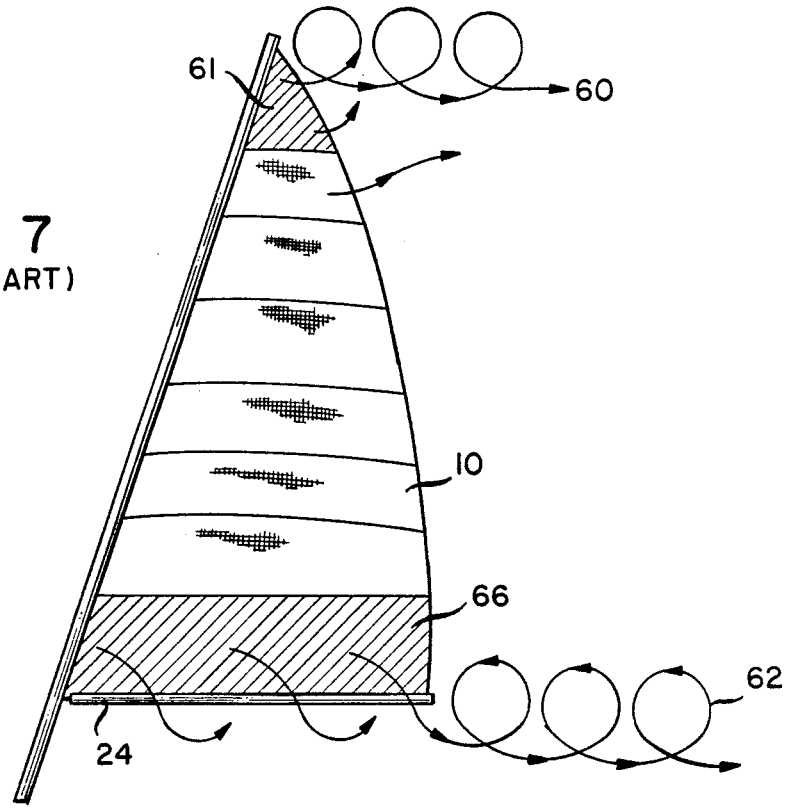
FIG. 7 (PRIOR ART)
FIG. 7 is an illustration of a mainsail of the prior art.

Typical airflow patterns are shown in the prior art drawing FIG. 7 wherein an airflow vortex 60 adjacent the upper portion of the mainsail 10 and the airflow vortex 62 is shown positioned adjacent the lowermost edge of the mainsail 10. The shaded areas 64 and 66 in FIG. 7 depict areas of reduced sail effectiveness resulting from the tendency of air to flow around the end of the sail and form vortex 60 and vortex 62 thereby reducing the driving pressure on mainsail 10. FIG. 1 illustrates reduced vortexes 68, 70, 72, 74 and 76. These smaller air vortices when compared to the large vortices 60 and 62 show the reduction in airflow from the high to low pressure side resulting in the positioning of the lower barrier 32 and at least one upper barrier 78 in the construction of the present invention. The upper barrier 78 is useful but the majority of airflow control is achieved by the lower barrier 32.

Figure 4:
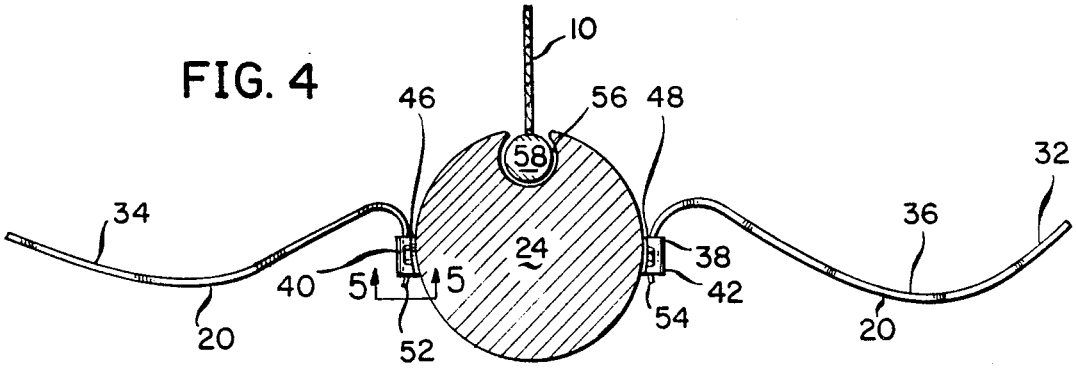
FIG. 4 is a cross-sectional view of FIG. 1 along lines 4—4.
Figure 5:
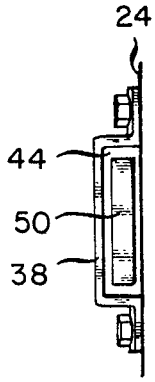
FIG. 5 is a cross-sectional view of FIG. 4 along lines 5—5.
Figure 2:
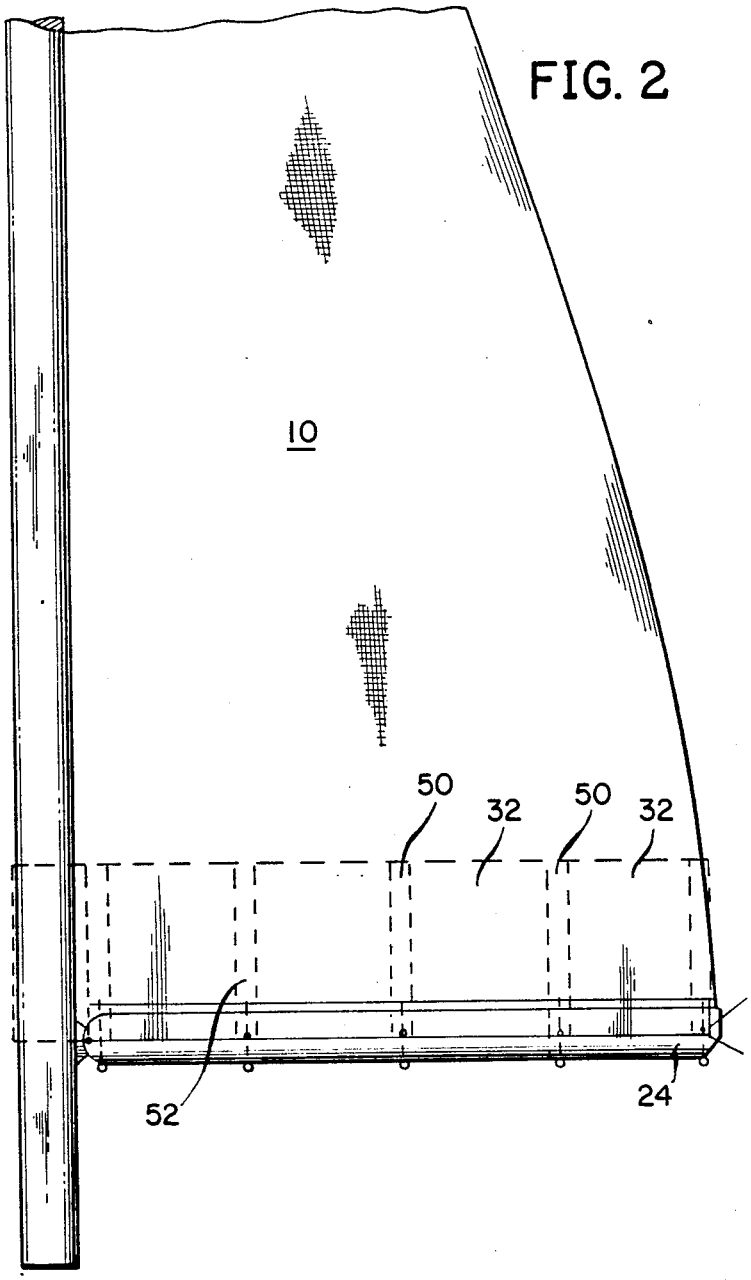
FIG. 2 is a side elevational view of the embodiment shown in FIG. 1 with the barrier in the closed sail cover position.

The barrier 32 preferably includes a first barrier member 34 and a second barrier 36 shown in the opened position 20 extending outwardly approximately horizontally from the mainsail boom 24 in FIG. 4. That figure illustrates the laterally horizontally oriented barrier members 34 and 36 in position to minimize the formation of a vortex near the lower or trailing edge of a mainsail 10. Preferably the barriers are attached with respect to the boom means by way of brackets 38.

Preferably brackets 38 include a first bracket 40 attached to one side of the mainsail boom and a second bracket 42 attached to the other side thereof. These brackets facilitate the attachment of the barrier with respect to the mainsail boom 24.

To aid the barrier means 34 in maintaining its expanded position extending out horizontally, a rib means 50 may be included therein. In particular, a plurality of first rib members 52 are preferably attached with respect to the first barrier member 34 to hold it in a horizontally extending position. These ribs will be at multiple locations which extend out horizontally and are formed of a more rigid material than the material of the barrier itself. Preferably the ribs are formed of a rigid material whereas the barriers are formed of a cloth-type sail material.

In a similar manner, a plurality of second rib members 54 will extend outwardly horizontally along the surface of the second barrier member 36 in order to maintain that barrier in a horizontally expanded position. Attachment of the rib members with respect to the associated barrier is best achievable by sewing of pockets along the barrier which are adapted to receive the rib member therein for maintaining securement therebetween.

Preferably the bracket means 38 will include slot means therein to facilitate detachable securement of the barriers 32 with respect to the mainsail boom 24. In this manner the first bracket means 40 will preferably define a first slot means 46 therein and a second bracket means 42 will preferably define a second slot means 48 therein. With this configuration, one of the first rib members 52 will be adapted to extend into the first slot means 46 defined in the first bracket means 40 to thereby detachably secure the first barrier member 34 with respect to the mainsail boom 24. In a similar manner, the second rib member 54 will be positionable extending into the second slot means 48 defined in the second bracket 42 in such a manner as to detachably retain the second barrier 36 with respect to the mainsail boom 24 extending outwardly in an opposite direction from the first barrier 34.

Attachment of the mainsail 10 with respect to the mainsail boom 24 may be with a loose footed sail attached at the forward and after end of the boom 24 or by a continuous attachment utilizing a boltrope 58. Boltrope 58 is normally sewn with respect to the lowermost edge of the mainsail 10. To retain the mainsail 10 with respect to the mainsail boom 24, the boltrope 58 is designed to be positionable within a retaining channel 56 best shown in FIG. 4 which is defined in the uppermost surface of mainsail boom 24.

With this configuration, the mainsail 10 is attached with respect to the upper portion of the mainsail boom 24 and the barriers 34 and 36 are attached to the mainsail boom 24 in such a manner as to extend outwardly and oppositely with respect to one another in an approximately horizontally extending direction. This is the preferred orientation of the barrier means of the present invention when in the opened position 20.

Figure 3:
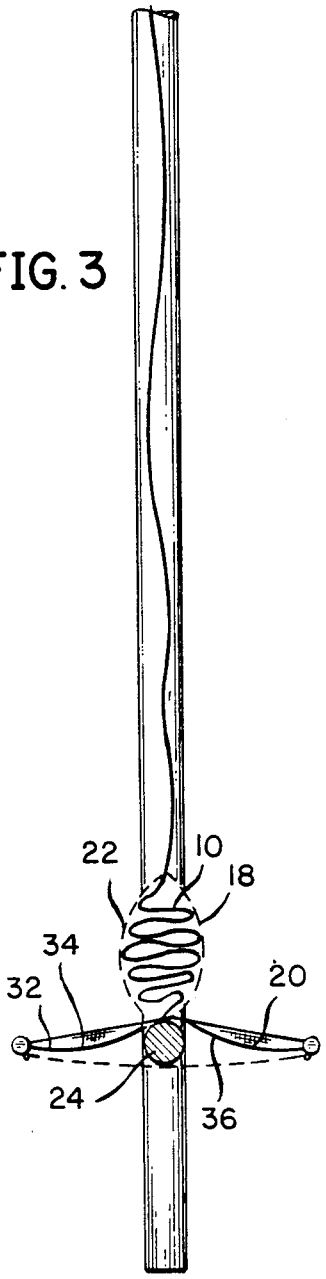
FIG. 3 is an end view of the embodiment shown in FIG. 2.
Figure 6:
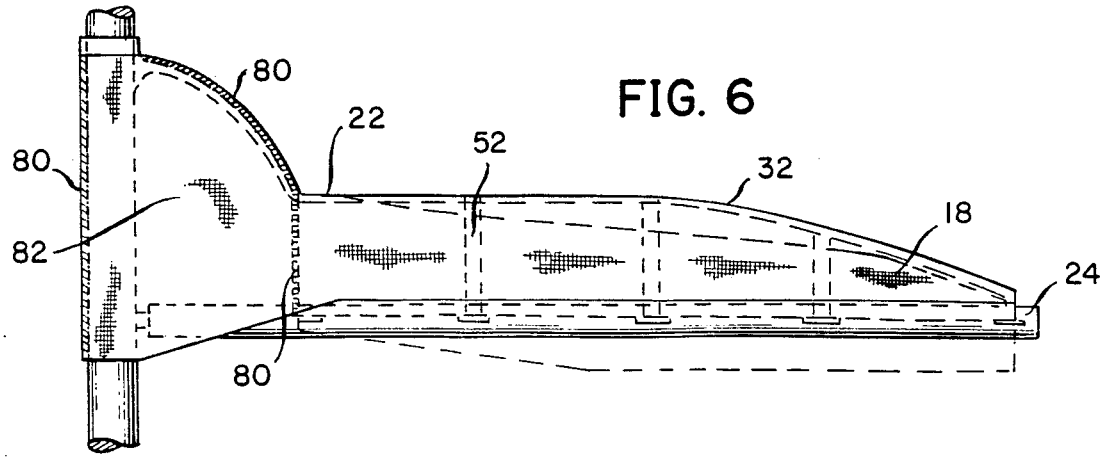
FIG. 6 is a side elevational view of an embodiment of the barrier of the present invention shown in the closed or weather protection position.

The present invention is designed to include the option of positioning of the first and second barriers 34 and 36 to a closed position 18 which provides a weather protection means 22. This configuration is best shown in FIG. 3 and FIG. 6. A forward closure cover 82 may be included attached by zipper means 80 with respect to the first and second barriers 34 and 36 as also shown in FIG. 6. The closure means can be formed in the left and right half sections which are secured in the uppermost edge and the forwardmost edge thereof by zipper means 80. In this closed position 18, the first and second barriers can also preferably be secured with respect to one another by one or more zippers 80 as shown in FIG. 6. This multiple utility of the barrier 32 of the present invention is a distinctly novel concept not shown or suggested in any prior art.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An improved mainsail construction facilitating airflow thereover comprising:
   (a) a mainsail means including a high pressure side and a low pressure side defined thereon; and
   (b) a barrier means attached with respect to said mainsail and extending outwardly therefrom to minimize airflow circulation from said high pressure side of said mainsail means to said low pressure side of said mainsail means, said barrier means adapted to maximize the effective area of said mainsail means utilized for producing driving force, said barrier means being movable between a closed position and an opened position adapted to extend over said mainsail means to facilitate covering thereof.

2. A mainsail construction as defined in claim 1 wherein sail barrier means is adapted to extend horizontally outwardly from said mainsail means to provide a weather protection means.

3. A mainsail construction as defined in claim 1 further including a boom jib attached with respect to said mainsail means and wherein said barrier means is attached with respect to said boom jib.

4. A mainsail construction as defined in claim 1 further including a mizzen sail attached with respect to said mainsail means and wherein said barrier means is attached with respect to said mizzen sail.

5. A mainsail construction comprising:
   (a) a mainsail boom means;
   (b) a mainsail means attached with respect to said mainsail boom means, said mainsail means including a high pressure side and a low pressure side defined thereon; and
   (c) a barrier means detachably mounted with respect to said mainsail boom means and extending outwardly therefrom to minimize airflow circulation from said high pressure side of said mainsail means to said low pressure side of said mainsail means, said barrier means adapted to maximize the effective area of said mainsail means utilized for producing driving force, said barrier means being movable between a closed position and an opened position, said barrier means when in the closed position adapted to extend over said mainsail means to facilitate covering thereof.

6. A mainsail construction as defined in claim 5 wherein sail barrier means is responsive to being in the opened position to extend generally horizontally outwardly from said mainsail boom means and said mainsail means.

7. A mainsail construction as defined in claim 5 further comprising bracket means fixedly mounted to said mainsail boom means.

8. A mainsail construction as defined in claim 7 wherein said barrier means includes a rib means adapted to detachably engage said bracket means to facilitate said barrier means extending outwardly from said mainsail boom means.

9. A mainsail construction as defined in claim 7 wherein said bracket means defines a slot means therein adapted to receive said barrier means extending therein for facilitating detachable mounting of said barrier means with respect to said mainsail boom means.

10. A mainsail construction as defined in claim 7 wherein said bracket means defines a slot means therein adapted to receive said barrier means extending therethrough to facilitate detachable securement thereof with respect to said main boom means.

11. A mainsail construction as defined in claim 10 wherein said barrier means includes a rib means comprising a plurality of rib members extending along said barrier means to facilitate expansion thereof.

12. A mainsail construction as defined in claim 11 wherein said rib means are adapted to removably extend into said slot means defined in said bracket means to facilitate detachable securement of said barrier means with respect to said mainsail boom means.

13. A mainsail construction as defined in claim 5 wherein said barrier means comprises a first barrier member and a second barrier member both detachably secured with respect to said mainsail boom means and extending outwardly therefrom in approximately opposite horizontal directions.

14. A mainsail construction as defined in claim 13 further comprising a first bracket means fixedly mounted to one side of said mainsail boom means and a second bracket means fixedly mounted to the other side of said mainsail boom means.

15. A mainsail construction as defined in claim 14 wherein said first barrier member includes a plurality of first rib members extending along said first barrier member to facilitate expansion thereof and wherein said second barrier member includes a plurality of second rib members extending along said second barrier member to facilitate expansion thereof.

16. A mainsail construction as defined in claim 15 wherein said first bracket means defines a first slot means therein adapted to receive said first rib member detachably retained therein to facilitate detachable securement of said first barrier member with respect to said mainsail boom means.

17. A mainsail construction as defined in claim 15 wherein said second bracket means defines a second slot means therein adapted to receive said second rib member detachably retained therein to facilitate detachable securement of said second barrier member with respect to said mainsail boom means.

18. A mainsail construction as defined in claim 5 wherein said mainsail boom means defines a retaining channel along the upper side thereof being adapted to receive said mainsail means secured therein to facilitate attachment of said barrier means with respect thereto.

19. A mainsail construction as defined in claim 18 wherein said mainsail means further comprises a boltrope means secured to the lower portion thereof with said boltrope means being adapted to be retained within said retaining channel of said mainsail boom means to facilitate attachment of said barrier means with respect to said mainsail means.

20. A mainsail construction as defined in claim 5 further comprising an upper barrier means positioned at an intermediate position between the upper end of said mainsail means and the lower end of said mainsail means to facilitate minimizing of airflow from the high pressure side of said mainsail means to the lower pressure side thereof about the trailing edge of said mainsail means.

21. A mainsail construction comprising:

(a) a mainsail boom means;

(b) a mainsail means attached with respect to said mainsail boom means, said mainsail means including a high pressure side and a low pressure side defined thereon;

(c) a barrier means detachably mounted with respect to said mainsail boom means and extending outwardly therefrom to minimize airflow circulation from said high pressure side of said mainsail means to said low pressure side of said mainsail means, said barrier means adapted to maximize the effective area of said mainsail means utilized for producing driving force, said barrier means being movable between a closed position and an opened position, said barrier means when in the closed position adapted to extend over said mainsail means to facilitate covering thereof, said barrier means including:

(1) a first barrier member detachably secured with respect to one side of said mainsail boom means and extending outwardly approximately horizontally therefrom, said first barrier member including a plurality of first rib members extending along said first barrier member to facilitate expansion thereof;

(2) a second barrier member detachably secured with respect to the other side of said mainsail boom means and extending outwardly therefrom in an approximately opposite horizontal direction, said second barrier member including a plurality of second rib members extending along said second barrier member to facilitate expansion thereof;

(d) a bracket means comprising;

(1) a first bracket member defining a first slot means therein adapted to receive said first rib member detachably retained therein to facilitate detachable securement of said first barrier member with respect to said mainsail boom means; and (2) a second bracket member defining a second slot means therein adapted to receive said second rib member detachably retained therein to facilitate detachable securement of said second barrier member with respect to said mainsail boom means.

* * * * *